US010166793B2

(12) United States Patent
Jimbo et al.

(10) Patent No.: US 10,166,793 B2
(45) Date of Patent: Jan. 1, 2019

(54) SERIAL-TYPE RECORDING APPARATUS

(71) Applicant: BROTHER KOGYO KABUSHIKI KAISHA, Nagoya-shi, Aichi-ken (JP)

(72) Inventors: Masaru Jimbo, Nagoya (JP); Hidenobu Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/696,620

(22) Filed: Sep. 6, 2017

(65) Prior Publication Data

US 2018/0072075 A1 Mar. 15, 2018

(30) Foreign Application Priority Data

Sep. 9, 2016 (JP) ..... 2016-176963

(51) Int. Cl.
*B41J 13/00* (2006.01)

(52) U.S. Cl.
CPC ..... *B41J 13/0009* (2013.01); *B41J 13/0027* (2013.01)

(58) Field of Classification Search
None
See application file for complete search history.

(56) References Cited

U.S. PATENT DOCUMENTS

2002/0039119 A1* 4/2002 Igarashi ..... B23Q 35/128 347/16
2008/0145123 A1* 6/2008 Kogure ..... B41J 11/007 399/395

FOREIGN PATENT DOCUMENTS

JP H01-103454 A 4/1989
JP H04-85045 A 3/1992
JP 2001-199117 A 7/2001

* cited by examiner

*Primary Examiner* — Erica Lin
(74) *Attorney, Agent, or Firm* — Scully, Scott, Murphy & Presser, PC

(57) ABSTRACT

A serial-type recording apparatus includes a controller configured to execute continuous recording processing in which, before completion of image recording on a first sheet fed before a second sheet, the second sheet is fed from a feed tray, wherein the controller is configured to: set a first current limit value in a first motor and drive the first motor having the first current limit value to feed the second sheet from the feed tray; and set a second current limit value in the first motor and drive the first motor having the second current limit value to refeed the second sheet from the feed tray, on condition that driving of a second motor has completed a last intermittent conveyance of the first sheet and feed failure of the second sheet has been determined based on a detection signal from a sheet sensor.

13 Claims, 6 Drawing Sheets

SERIAL-TYPE RECORDING APPARATUS

CROSS REFERENCE TO RELATED APPLICATION

The present application claims priority from Japanese Patent Application No. 2016-176963 filed on Sep. 9, 2016, the disclosure of which is incorporated herein by reference in its entirety.

BACKGROUND OF THE INVENTION

Field of the Invention

The present invention relates to a serial-type recording apparatus that performs continuous recording processing by feeding a second sheet that is subsequent to a first sheet, before completing image recording on the first sheet fed before the second sheet.

Description of the Related Art

An ink-jet recording apparatus, which is an exemplary serial-type recording apparatus, feeds a sheet from a sheet loading part, such as a sheet tray, to a conveyance path by use of a feed roller. In an image recording operation, a conveyance roller disposed in the conveyance path intermittently conveys the sheet by a predefined distance, and in a state where the conveyance of the sheet by use of the conveyance roller is stopped, a recording head jets ink on the sheet by an amount corresponding to one pass during movement of a carriage. Performing the intermittent conveyance and the ink jetting corresponding to one pass alternately and repeatedly records images on the sheet. The sheet for which image recording has been performed is discharged from the conveyance path. When there is printing data for a subsequent page, the next sheet is fed from the sheet feeding part and the same operation is performed on the next sheet.

In order to reduce the power consumption of the ink-jet recording apparatus and to use an inexpensive lower-capacity power source, Japanese Patent Application Laid-open No. H04-85045 discloses that driving of components is controlled so that a heater increasing ink temperature and motors for sheet conveyance and carriage movement are not driven at the same time.

In order to meet high-speed image recording, there is an ink-jet recording apparatus that performs continuous recording processing in which, before completion of image recording on a first sheet fed before a second sheet, feeding of the second sheet, which is subsequent to the first sheet, is performed. In the continuous recording processing, a motor conveying the first sheet, a motor feeding the second sheet, and a motor moving a carriage may be driven at the same time. Further, in order to improve throughput of the ink-jet recording apparatus, the carriage is allowed to start to move before the intermittent conveyance of the recording sheet is completed.

The respective motors of the ink-jet recording apparatus are subjected to, for example, PWM control. The respective motors have current limit values, respectively. Although all the motors are not likely to have maximum currents corresponding to the respective current limit values at the same time, for example, when a great load is applied to the sheet conveyance, a great current flows through the respective motors driving the feed roller and the conveyance roller. Incorporating a large-capacity power source and a motor driver that meet the total of the current limit values of the respective motors into the ink-jet recording apparatus would increase costs.

The present teaching has been made in view of the above circumstances, and an object of the present teaching is to provide a serial-type recording apparatus that can reduce power consumption of motors, can use a power source having a capacity smaller than the total of current limit values of the motors, and can prevent deterioration in throughput in continuous recording processing.

SUMMARY OF THE INVENTION

According to an aspect of the present teaching, there is provided a serial-type recording apparatus, including:

- a casing including a conveyance path configured to guide a sheet in a conveyance direction;
- a feed tray configured to load sheets;
- a feed roller configured to feed each sheet loaded on the feed tray to the conveyance path;
- a conveyance roller pair provided in the conveyance path and configured to convey the sheet in the conveyance direction while nipping the sheet;
- a carriage provided in the conveyance path at a position downstream of the conveyance roller pair in the conveyance direction and configured to move in a direction intersecting with the conveyance direction;
- a recording head carried on the carriage;
- a sheet sensor provided in the conveyance path at a position upstream of the conveyance roller pair in the conveyance direction and configured to detect whether or not the sheet is present;
- a first motor configured to drive the feed roller;
- a second motor configured to drive the conveyance roller pair;
- a third motor configured to drive the carriage;
- a controller configured to control the first motor, the second motor, and the third motor to execute continuous recording processing in which, before completion of image recording on a first sheet fed before a second sheet, the second sheet is fed from the feed tray; and
- a memory storing a first current limit value and a second current limit value larger than the first current limit value, of the first motor, wherein the controller is configured to:

- drive the second motor to perform intermittent conveyance of the first sheet;
- drive the third motor to perform one-pass image recording on the first sheet by use of the recording head while moving the carriage, at least in a state where the first sheet is stopped;
- perform the intermittent conveyance and the one-pass image recording alternately and repeatedly to complete the image recording on the first sheet;
- set the first current limit value in the first motor and drive the first motor having the first current limit value to feed the second sheet from the feed tray before completion of the image recording on the first sheet; and
- set the second current limit value in the first motor and drive the first motor having the second current limit value to refeed the second sheet from the feed tray, on condition that driving of the second motor has completed a last intermittent conveyance of the first sheet and feed failure of the second sheet has been determined based on a detection signal from the sheet sensor.

DESCRIPTION OF THE EMBODIMENTS

Figure 1:
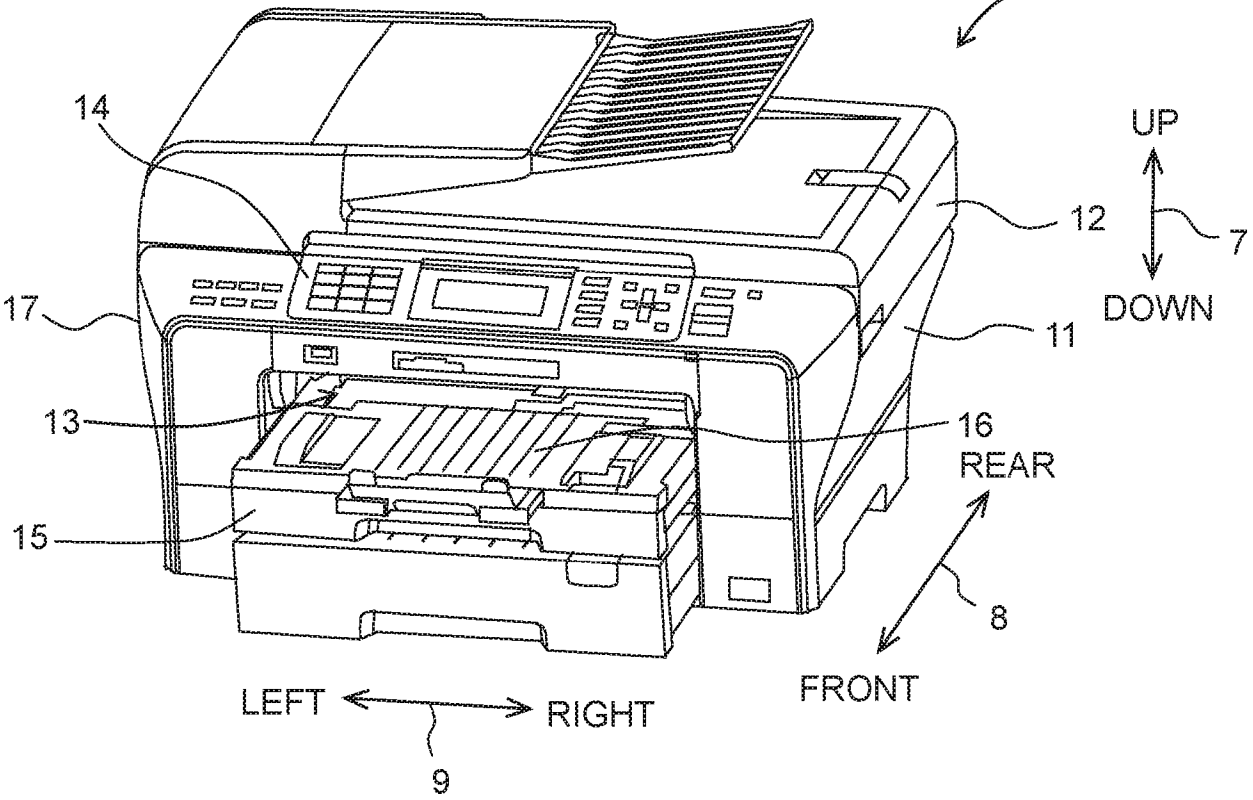
FIG. 1 is a perspective view depicting an appearance of a multifunction peripheral according to an embodiment of the present teaching.

The following explains an embodiment of the present teaching with reference to the drawing as appropriate. The embodiment described below is merely an example in which the present teaching is embodied. It goes without saying that the embodiment can be appropriately changed within a range without changing the gist or essential characteristics of the present teaching.

[Schematic Configuration of Multifunction Peripheral 10]

As depicted in FIG. 1, a multifunction peripheral 10 (an exemplary serial-type recording apparatus) includes a printer unit 11 and a scanner unit 12, which is, for example, a flat-bed scanner. The multifunction peripheral 10 has a print function, a scan function, a copy function, and a facsimile function. The functions except for the printer unit 11 are optional. For example, the serial-type recording apparatus may be a single-function printer not including the scanner unit 12, namely, not having the scan function and the copy function. In the following explanation, an up-down direction 7 is defined on the basis of a state in which the multifunction peripheral 10 is placed to be usable (the state depicted in FIG. 1). A front-rear direction 8 is defined as an opening 13 of the multifunction peripheral 10 is provided on the near side. A left-right direction 9 is defined as the multifunction peripheral 10 is seen from the near side.

A lower portion of the multifunction peripheral 10 is provided with the printer unit 11 and an upper portion of the multifunction peripheral 10 is provided with the scanner unit 12. The printer unit 11 is connected typically to an external information device, such as a computer. The printer unit 11 records an image and/or a character on a recording sheet based on printing data including image data and/or document data transmitted from the external information device.

The multifunction peripheral 10 has a casing 17 in a substantially rectangular parallelepiped shape. A front surface of the printer unit 11 is provided with the opening 13. In the opening 13, a feed tray 15 (an exemplary sheet loading part) and a discharge tray 16 are placed. The recording sheet 90 (FIG. 2) in the feed tray 15 is fed to the inside of the printer unit 11, a desired image is recorded on the recording sheet 90, and the recording sheet 90 after image recording is discharged on the discharge tray 16.

An upper front part of the multifunction peripheral 10 is provided with an operation panel 14. A user inputs an instruction through the operation panel 14 to cause the printer 11 and the scanner unit 12 to perform a desired operation. The operation panel 14 includes buttons through which the user inputs instructions and/or a display on which a state of the multifunction peripheral 10 and an error indication are displayed. When the multifunction peripheral 10 is connected to the external information device, the multifunction peripheral 10 operates also based on an instruction sent from the external information device by the aid of a communication software, such as a printer driver and a scanner driver.

<Printer Unit 11>

Figure 2:
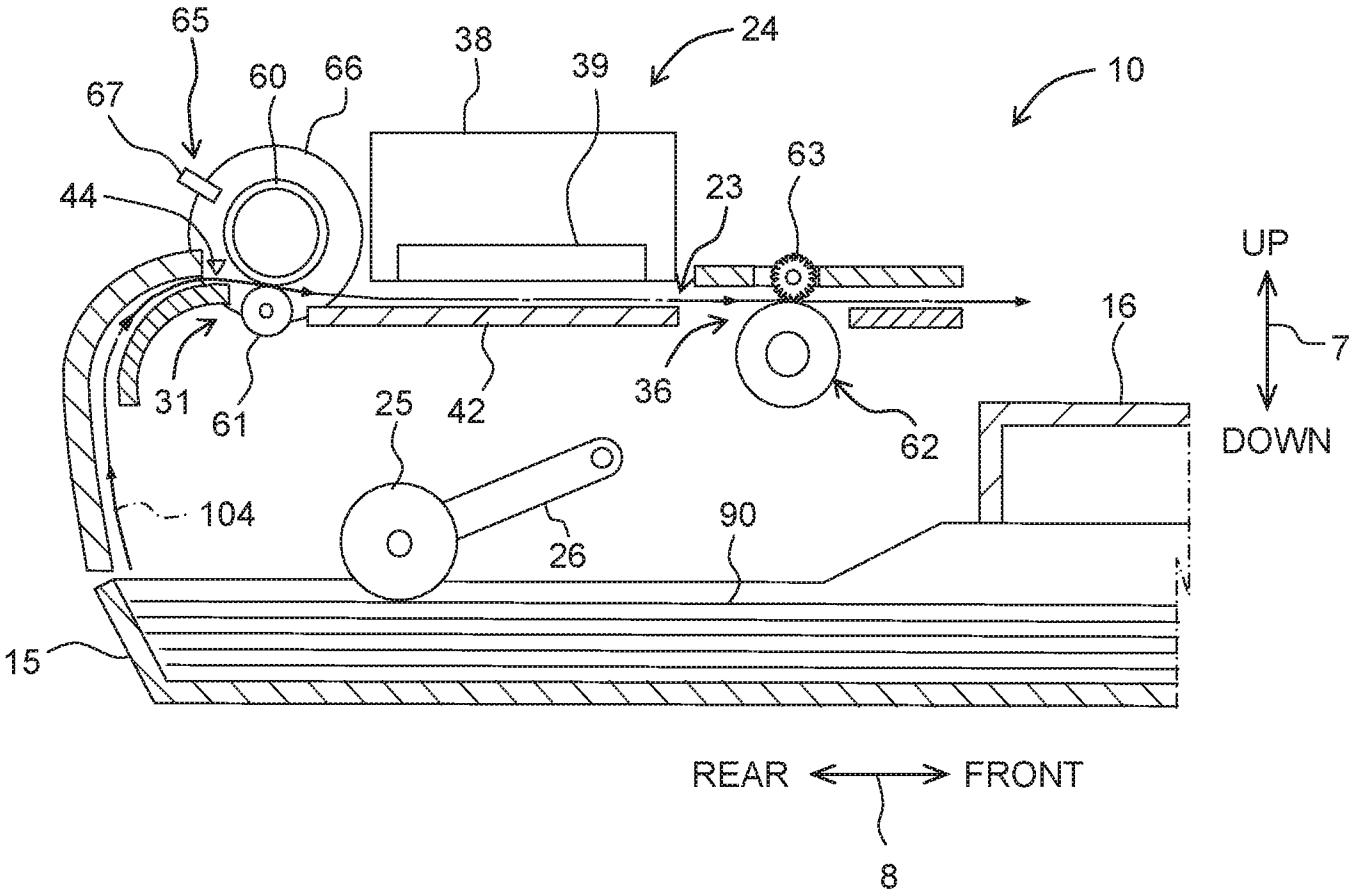
FIG. 2 schematically depicts an internal structure of a printer unit.

As depicted in FIG. 2, a lower portion of the multifunction peripheral 10 is provided with the feed tray 15. The discharge tray 16 is disposed at the upper side of the feed tray 15. The recording sheet 90 in the feed tray 15 is conveyed from the lower side to the upper side to make a U-turn through the conveyance path 23 and reaches the recording unit 24. Then, the recording unit 24 performs image recording on the recording sheet 90 positioned therebelow, and then the recording sheet 90 for which the image recording has been performed is discharged on the discharge tray 16. Although another tray is disposed below the feed tray 15 in FIG. 1, the another tray may not be provided in the multifunction peripheral 10.

The feed tray 15 is a container of which upper side is open. The feed tray 15 loads the recording sheets 90 (an exemplary sheet) in its internal space. The feed tray 15 can load the recording sheets 90 in various sizes, such as A3, A4, B5, and a postcard.

The discharge tray 16 is disposed above the feed tray 15 at the front side in the front-rear direction 8. The recording sheet 90 is discharged on an upper surface of the discharge tray 16.

The feed roller 25 is provided above the feed tray 15 at the rear side in the front-rear direction 8. The feed roller 25 supplies each recording sheet 90 in the feed tray 15 toward the recording unit 24. The feed roller 25 rotates when receiving driving force transmitted from an ASF motor 83 (see FIG. 3, an exemplary first motor). The feed roller 25 is rotatably supported by a front end of the feed arm 26. The feed arm 26 can pivot with the feed roller 25 as a pivoting front end. The pivoting causes the feed roller 25 to move upward and downward so that the feed roller 25 approaches or separates from the feed tray 15. The feed arm 26 pivots downward due to the weight of the feed roller 25 or by being urged by a spring or the like and moves upward depending on the amount of the recording sheets 90 in the feed tray 15. This allows the feed roller 25 to make contact with the uppermost recording sheet 90 in the feed tray 15. Rotating the feed roller 25 with the feed roller 25 being in contact with the uppermost recording sheet 90 causes the friction force between a roller surface of the feed roller 25 and the recording sheet 90, sending the uppermost recording sheet 90 to the conveyance path 23.

The conveyance path 23 is formed in the casing. The conveyance path 23 extends upward from a rear portion of the feed tray 15, curves toward the front side of the multifunction peripheral 10, runs frontward below the recording unit 24, and reaches the discharge tray 16. Except for portions including the recording unit 24 and the like, the conveyance path 23 is formed by guide members facing each other at a predefined interval. The conveyance path 23 conveys the recording sheet 90 in a conveyance direction 104. The conveyance direction 104 is a direction that goes upward from the rear end of the feed tray 15 toward the slightly rear side of the multifunction peripheral 10, curves at the upper rear side of the multifunction peripheral 10, and goes frontward. In the following explanation, an "upstream" and a "downstream" are defined based on the conveyance direction 104. For example, an "upstream side" is a position close to the feed tray 15 in the conveyance direction 104 and a "downstream side" is a position close to the discharge tray 16 in the conveyance direction 104.

As depicted in FIG. 2, the recording unit 24 mainly includes a carriage 38, a recording head 39, and a platen 42. The carriage 38 and the platen 42 are respectively disposed on the upper and lower sides of the conveyance direction 23 at a position between a first conveyance roller 60 and a second conveyance roller 62. The carriage 38 carries the recording head 39 of an ink-jet type (an exemplary ink-jet head). The carriage 38 reciprocates in the left-right direction 9 (a direction perpendicular to the paper surface of FIG. 2) orthogonal to the conveyance direction 104 at a position above the conveyance path 23, when receiving driving force transmitted from a CR motor 79 (see FIG. 3, an exemplary third motor). Although not illustrated in FIG. 3, a cyan ink (C), a magenta ink (M), a yellow ink (Y), and a black ink (Bk) are supplied from ink cartridges placed independently of the recording head 39 in the multifunction peripheral 10 to the recording head 39 via ink tubes.

The platen 42 is disposed on the lower side of the conveyance path 23 to face the recording head 39. The platen 42 extends along a center area of a range in which the carriage 38 reciprocates, the center area being an area through which the recording sheet 90 passes. The width of the platen 42 is considerably larger than the maximum width of each recording sheet that can be used in the printer unit 11. The recording sheet 90 supported on the upper surface of the platen 42 has a constant distance from the recording head 39.

As described below, the first conveyance roller 60 and the second conveyance roller 62 are intermittently driven during image recording. The carriage 38 reciprocates while the first conveyance roller 60 and the second conveyance roller 62 are stopped. The color inks are selectively jetted as fine ink droplets from nozzles of the recording head 39 during the reciprocatingly movement of the carriage 38. The ink droplets jetted from the nozzles of the recording head 39 land on the recording sheet 90 that is placed on the platen 42 in a state of being stopped. Each conveyance roller may rotate even before the carriage 39 stops, on condition that ink jetting has been completed.

A first roller pair 31 (an exemplary conveyance roller pair), which is formed by the first conveyance roller 60 and a pinch roller 61, is provided upstream of the recording unit 24. The first conveyance roller 60 is disposed on the upper side of the conveyance path 23, and the pinch roller 61 is disposed on the lower side of the conveyance path 23. The pinch roller 61 is provided to approach or separate from the first conveyance roller 60, and the pinch roller 61 is brought into pressure contact with the first conveyance roller 60 by being urged by an elastic member, such as a spring. The first conveyance roller 60 rotates when receiving driving force transmitted from a LF motor 77 (see FIG. 3, an exemplary second motor). The recording sheet 90 nipped between the first conveyance roller 60 and the pinch roller 61 is conveyed in the conveyance direction 104 due to the rotation of the first conveyance roller 60. In that situation, the pinch roller 61 rotates along with the conveyance of the recording sheet 90. The first conveyance roller 60 has a cylindrical shape that is long in the left-right direction 9.

As depicted in FIG. 2, the first conveyance roller 60 includes a rotary encoder 65. The rotary encoder 65 and the first conveyance roller 60 are placed concentrically. The rotary encoder 65 is formed by an encoder disk 66 that rotates together with the first conveyance roller 60 and a transmission-type optical sensor 67. In the encoder disk 66, transmissive parts and non-transmissive parts are arranged alternately in its circumferential direction at regular pitches. Although not illustrated in FIG. 2, the optical sensor 67 includes a light emitting element that emits light to the encoder disk 66 and a light receiving element that is disposed to face the light emitting element via the encoder disk 66 to receive the light from the light emitting element. Rotating the encoder disk 66 together with the first conveyance roller 60 causes the non-transmissive parts of the encoder disk 66 to block the light emitted from the light emitting element of the optical sensor 67 at regular intervals. The light receiving element outputs an electrical pulse signal depending on the intensity of the received light. The rotation amount of the first conveyance roller 60 is determined based on the pulse signal.

As depicted in FIG. 2, a second roller pair 36, which is formed by the second conveyance roller 62 and a spur 63, is disposed downstream of the recording unit 24. The second conveyance roller 62 is disposed on the lower side of the conveyance path 23, and the spur 63 is disposed on the upper side of the conveyance path 23. The spur 63 is provided to approach or separate from the second conveyance roller 62, and the spur 63 is brought into pressure contact with the second conveyance roller 62 by being urged by an elastic member, such as a spring. The second conveyance roller 62 rotates when receiving driving force transmitted from the LF motor 77 (see FIG. 3). The rotation of the second conveyance roller 62 is synchronized with the rotation of the first conveyance roller 60. The second roller pair 36 conveys the recording sheet 90, for which image recording has been completed, in the conveyance direction 104 in a state of nipping it. This allows the recording sheet 90 to reach the discharge tray 16.

As depicted in FIG. 2, a resist sensor 44 (an exemplary sheet sensor) is disposed upstream of the first roller pair 31. The resist sensor 44 detects the presence or absence of the recording sheet 90 passing through the conveyance path 23. The resist sensor 44 may be any sensor, such as a mechanical sensor or an optical sensor. When no recording sheet 90 is at a position at which the resist sensor 44 is disposed, the resist sensor 44 outputs an OFF signal. When the recording sheet 90 is at the position at which the resist sensor 44 is disposed, the resist sensor 44 outputs an ON signal. A controller 70 determines, based on the change between the ON signal and the OFF signal from the resist sensor 44, whether the upstream end or the downstream end of the recording sheet 90 has reached the position at which the resist sensor 44 is provided, that is, the presence or absence of the recording sheet 90.

<Controller 70>

The following explains a configuration of the controller 70 of the multifunction peripheral 10. The controller 70 controls not only an operation of the printer unit 11 but also an operation of the scanner unit 12. In the present teaching, however, the scanner unit 12 is optional. Thus, the present specification omits the explanation for the configuration related to the operation of the scanner unit 12.

Figure 3:
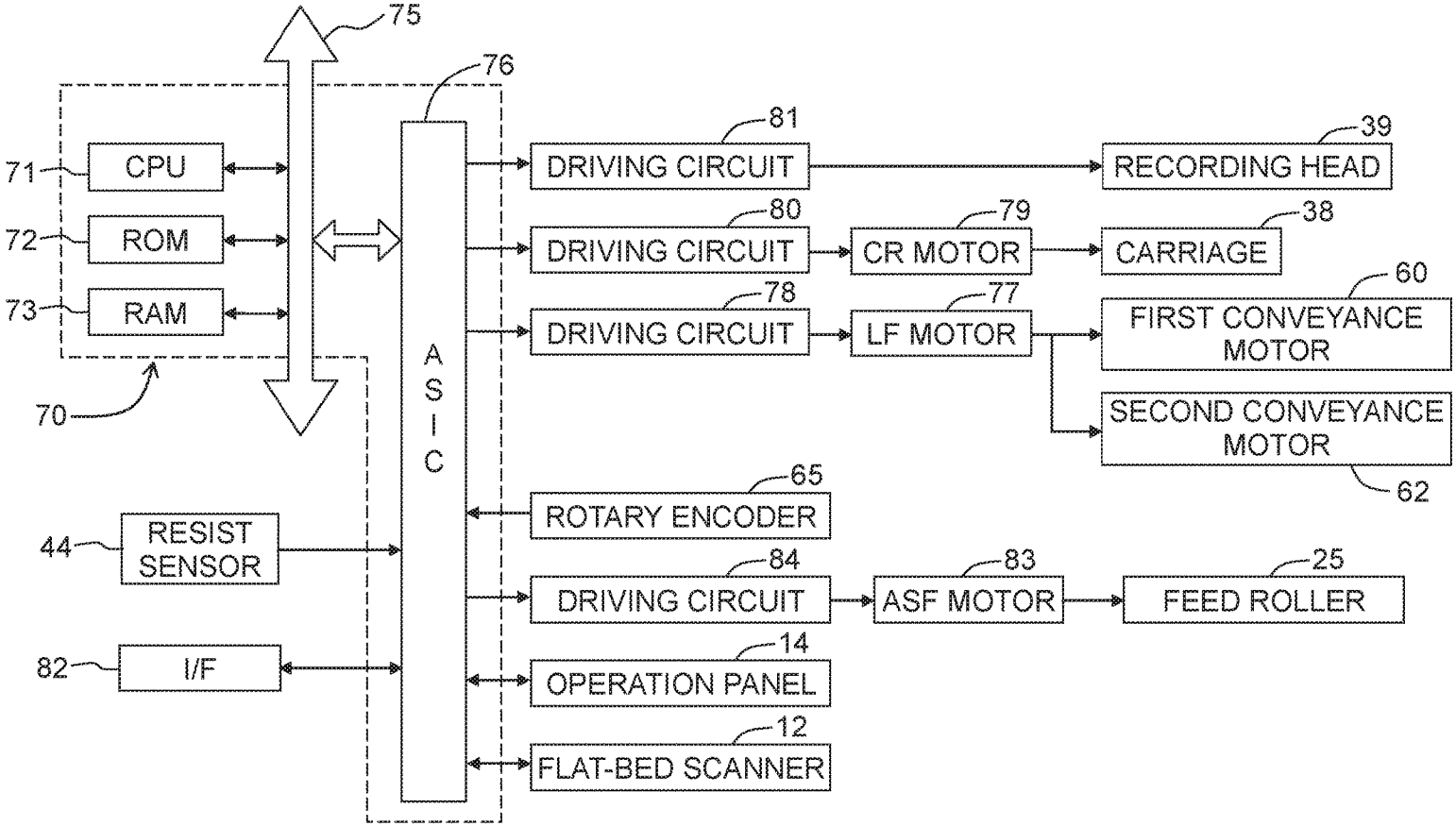
FIG. 3 is a block diagram depicting a configuration of a controller.

As depicted in FIG. 3, the controller 70 mainly includes a Central Processing Unit (CPU) 71, a Read Only Memory (ROM) 72, a Random Access Memory (RAM) 73, and an Application Specific Integrated Circuit (ASIC) 76. The controller 70 is connected to the printer unit 11, the scanner unit 12, the operation panel 14, and the like via a bus 75 so that data transmission and reception can be performed therebetween.

The ROM 72 (an exemplary memory) stores programs and the like to control various operations of the multifunctional peripheral 10. The ROM 72 stores current limit values of the LF motor 77, the CR motor 79, and the ASF motor 83. The current limit values of the ASF motor 83 include a first current limit value L1 and a second current limit value L2. The second current limit value L2 is larger than the first current limit value L1 (L2>L1). The first current limit value L1 may be smaller than the current limit value of the LF motor 77.

Here, the total of the first current limit value L1, the current limit value of the LF motor 77, and the current limit value of the CR motor 79 is not more than a maximum current value of a power source of the multifunction peripheral 10. The total of the second current limit value L2 and the current limit value of the CR motor 79 is not more than the maximum current value of the power source of the multifunction peripheral 10. The total of the second current limit value L2, the current limit value of the LF motor 77, and the current limit value of the CR motor 79 may exceed the maximum current value of the power source of the multifunction peripheral 10.

The RAM 73 is used as a storage area or a working area that temporarily stores a variety of data to be used when the CPU 71 executes each of the programs.

The ASIC 76 generates, based on a command from the CPU 71, a PWM signal or the like to be applied to the ASF motor 83, and applies the signal to a driving circuit 84 of the ASF motor 83. The controller 70 executes rotation control of the ASF motor 83 by transmitting the driving signal to the ASF motor 83 via the driving circuit 84.

The driving circuit 84 drives the ASF motor 83 that transmits driving force to the feed roller 25. The driving circuit 84 generates an electrical signal to rotate the ASF motor 83 when receiving an output signal from the ASIC 76. The ASF motor 83 rotates when receiving the electrical signal. The rotation of the ASF motor 83 is transmitted to the feed roller 25 via a known driving mechanism formed by gears, a driving shaft, and the like.

The ASIC 76 generates, based on a command from the CPU 71, a PWM signal or the like to be applied to the LF motor 77, and applies the signal to a driving circuit 78 of the LF motor 77. The controller 70 executes rotation control of the LF motor 77 by transmitting the driving signal to the LF motor 77 via the driving circuit 78.

The driving circuit 78 drives the LF motor 77 that transmits driving force to the first conveyance roller 60 and the second conveyance roller 62. The driving circuit 78 generates an electrical signal to rotate the LF motor 77 when receiving an output signal from the ASIC 76. The LF motor 77 rotates when receiving the electrical signal. The rotation of the LF motor 77 is transmitted to the first conveyance roller 60 and the second conveyance roller 62 via a known driving mechanism formed by gears, a driving shaft, and the like, thus rotating the first conveyance roller 60 along with the second conveyance roller 62.

The ASIC 76 generates, based on a command from the CPU 71, a PWM signal or the like to be applied to the CR motor 79, and applies the signal to a driving circuit 80 of the CR motor 79. The controller 70 executes rotation control of the CR motor 79 by transmitting the driving signal to the CR motor 79 via the driving circuit 80.

The driving circuit 80 drives the CR motor 79 that transmits driving force to the carriage 38. The driving circuit 80 generates an electrical signal to rotate the CR motor 79 when receiving an output signal from the ASIC 76. The CR motor 79 rotates when receiving the electrical signal. Transmitting the rotation of the CR motor 79 to the carriage 38 via a belt driving mechanism moves the carriage 38.

The driving circuit 81 selectively jets each of the color inks from the recording head 39 to the recording sheet 90 at a predefined timing. The ASIC 76 generates an output signal based on a driving control procedure outputted from the CPU 71. The driving circuit 81 drives and controls the recording head 39 based on the output signal.

The ASIC 76 is connected to the resist sensor 44. A detection result based on the detection signal of the resist sensor 44 is stored in an unillustrated storage area (a register) of the ASIC 76. The CPU 71 analyzes the detection signal and determines a position of the upstream end or downstream end of the recording sheet 90, based on a program stored in the ROM 72. The CPU 71 determines positions of the upstream and downstream ends of the recording sheet 90, based on the timing at which the upstream end or downstream end of the recording sheet 90 is detected and the rotation amount of the first conveyance roller 60.

The ASIC 76 is connected to the operation panel 14. The operation instruction to the printer unit 11 inputted through the operation panel 14, the size of the recording sheet 90, and the resolution of the image to be recorded are stored, as size information and resolution information, in the RAM 73 through the ASIC 76 and the bus 75.

The ASIC 76 is connected to the interface (I/F) 82. The controller 70 transmits and receives data to and from the external information device via the interface 82. The external information device is, for example, a computer having a printer driver installed. Namely, the size and the resolution that are inputted to operate the printer unit 11 may be inputted from the operation panel 14 or the printer driver of the external information device.

[Operation of Printer Unit 11]

Figure 4A:
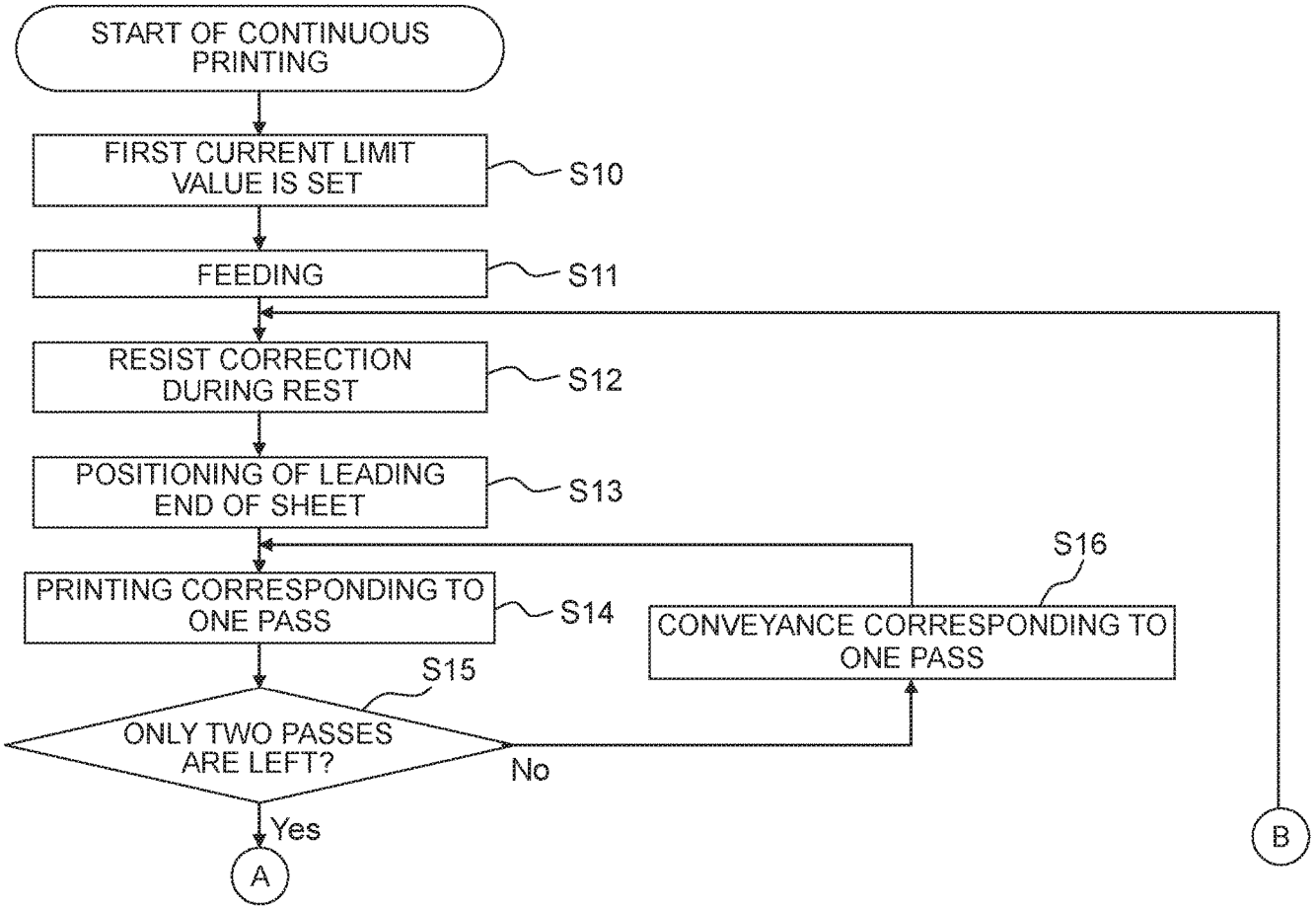
FIGS. 4A and 4B are flowcharts indicating continuous recording processing.
Figure 4B:
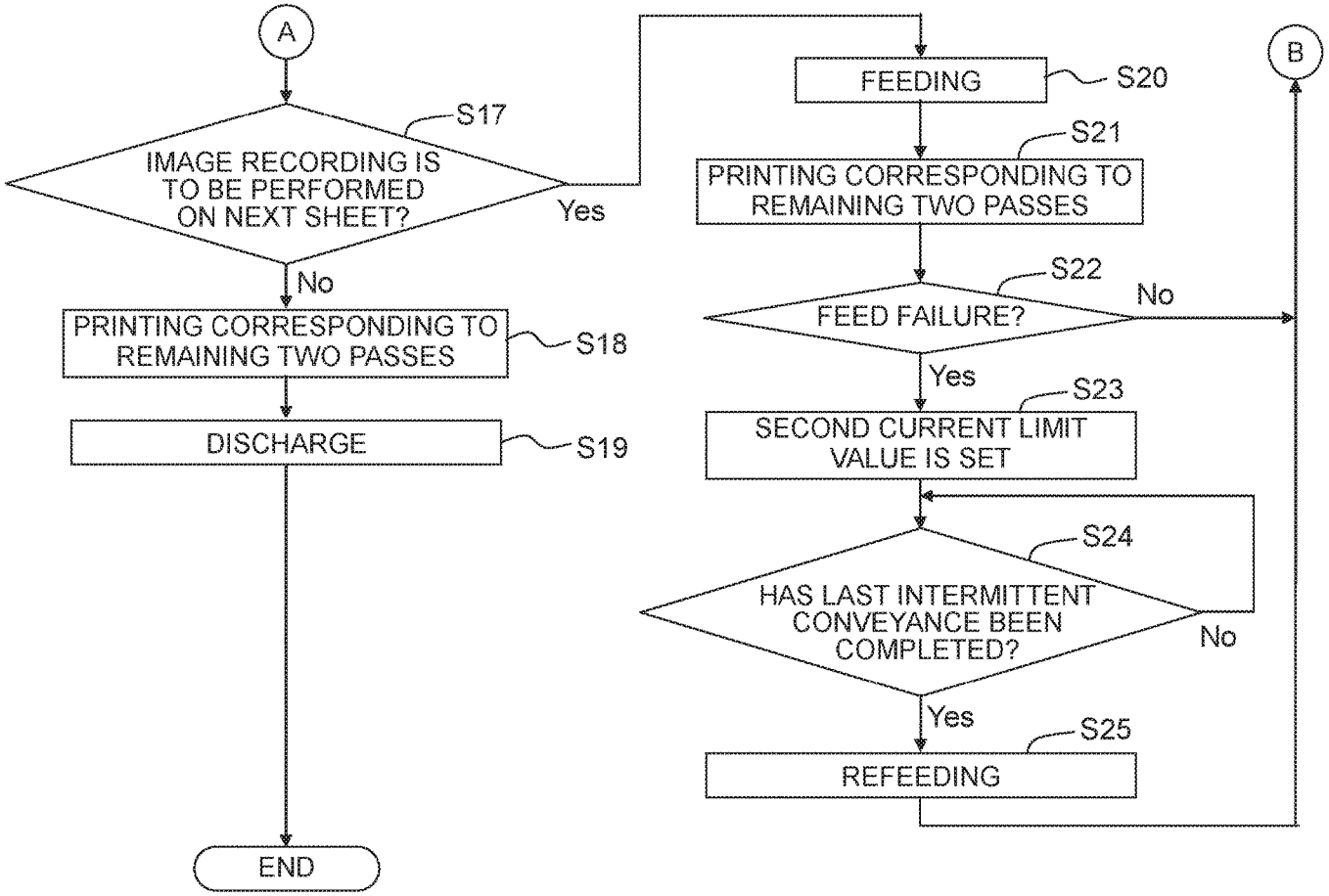
Figure 5:
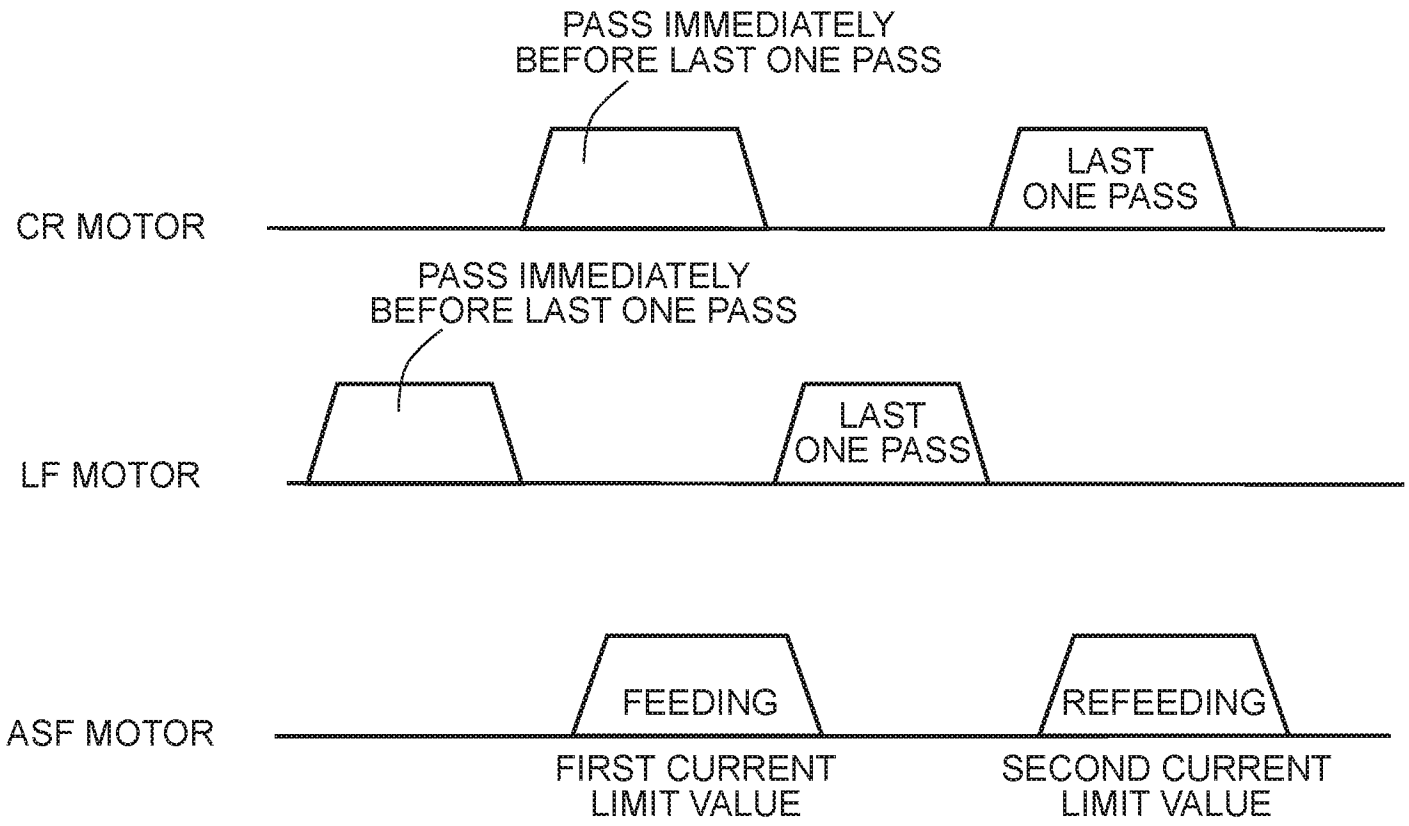
FIG. 5 is a timing chart indicating driving of respective motors in feed processing and refeed processing.

The following explains, with reference to FIGS. 4 and 5, image recording which is performed on the recording sheets 90 by the printer unit 11. The printer unit 11 performs continuous recording processing by feeding the next recording sheet 90 (an exemplary second sheet) from the feed tray 15 before completing image recording on the preceding recording sheet 90 (an exemplary first sheet) fed before the next recording sheet 90. A user chooses the continuous recording processing or normal recording processing, and inputs it on the operation panel 14 or the printer driver, the normal recording processing being processing in which the next recording sheet 90 is fed from the feed tray 15 after completion of discharge of the preceding recording sheet 90.

When a printing instruction is inputted on the operation panel 14, the controller 70 reads the first current limit value L1 from the ROM 72 to set it as the current limit value of the ASF motor 83 (S10). Similarly, the controller 70 reads the current limit values of the LF motor 77 and the CR motor 79 from the ROM 72 to set them as their current limit values, respectively.

Subsequently, the controller 70 drives the ASF motor 83 to rotate the feed roller 25. This feeds the recording sheet 90 from the feed tray 15 to the conveyance path 23 (S11, exemplary feed processing). The controller 70 monitors the output of the resist sensor 44 while driving the ASF motor 83, and determines whether a leading end of the recording sheet 90 reaches the position of the resist sensor 44. Upon receiving the ON signal of the resist sensor 44, the controller 70 determines that the leading end of the recording sheet 90 reaches the position of the resist sensor 44. Then, the controller 70 drives the ASF motor 83 for a predefined time. The predefined time is set, in advance, as time required for allowing the leading end of the recording sheet 90 positioned at the position of the resist sensor 44 to reach the first roller pair 31 and conveying the recording sheet 90 by a conveyance amount necessary to correct a recording sheet skew. The controller 70 applies, to the LF motor 77, a holding current for keeping the first conveyance roller 60 in a rest state. This causes the leading end of the recording sheet 90 to make contact with the first roller pair 31 in the rest state, correcting the skew of the recording sheet 90 (S12, exemplary sheet skew correction processing). This operation will be also referred to as "resist correction during rest".

Subsequently, the controller 70 stops the driving of the ASF motor 83 and drives the LF motor 77. This rotates the first roller pair 31 and the second roller pair 36. The recording sheet 90 of which leading end is in contact with the first roller pair 31 is conveyed toward the platen 42 in a state of being nipped by the first roller pair 31. The controller 70 recognizes the rotation amount after the rotation of the first conveyance roller 60 is started, based on the pulse signal of the rotary encoder 65. This allows the controller 70 to determine the position of the leading end of the recording sheet 90. The controller 70 continuously drives the LF motor 77 until the leading end of the recording sheet 90 reaches an image recording start position on the platen 42. Then, the controller 70 stops the LF motor 77. This stops the recording sheet 90 in a state where the leading end of an area where an image is to be recorded of the recording sheet 90 is positioned immediately below most upstream nozzles of the recording head 39 (S13). Namely, positioning of the leading end of the recording sheet 90 is completed.

Upon completing the positioning of the leading end of the recording sheet 90, the controller 70 drives the CR motor 79 and selectively jets ink droplets from the recording head 39 based on printing data. Accordingly, image recording is performed from the leading end of the recording sheet 90 (S14, exemplary recording processing). The unit corresponding to the image recording in which ink droplets are jetted from the recording head 39 during one reciprocation of the carriage 38 is referred to as one pass in the present specification.

Upon completing image recording corresponding to the first one pass (first one-pass image recording), the controller 70 determines whether only two passes are left to perform the image recording on the recording sheet 90 based on the printing data (S15). When the controller 70 determines that more than two passes are left (S15: No), namely, when the controller 70 determines that the next pass (the second one pass) is not a pass immediately before the last one pass to be performed on the first sheet, the controller 70 stops the CR motor 79 and drives the LR motor 77 again to rotate the first conveyance roller 60. The controller 70 stops the first conveyance roller 60 after rotating it by a predefined rotation amount. Thus, the recording sheet 90 is stopped after being conveyed in the conveyance direction 104 by a predefined distance (S16, exemplary intermittent conveyance processing). The conveyance, in which the recording sheet 90 is conveyed in the conveyance direction 104 by the predefined distance and then stopped, is referred to as the intermittent conveyance.

When the recording sheet 90 is stopped, the controller 70 drives the CR motor 79 to selectively jet ink droplets from the recording head 39 based on the printing data. Accordingly, image recording corresponding to the second one pass (second one-pass image recording) is performed (S14). Upon completing the second one-pass image recording, similarly to the above method, the controller 70 stops the CR motor 79, drives the LF motor 77 again to rotate the first conveyance roller 60 by the predefined rotation amount so that the recording sheet 90 is conveyed in the conveyance direction 104, and then stops the first conveyance roller 60 (S16). After that, similarly to the above method, the controller 70 performs image recording corresponding to the third one pass (third one-pass image recording) (S14). Accordingly, alternatively performing the intermittent conveyance based on the predefined rotation amount and the image recording corresponding to one pass (one-pass image recording) sequentially records images on the recording sheet 90 from its downstream side to its upstream side.

The controller 70 may drive the CR motor 79 to move the carriage 38 before the driving of the LF motor 77, which causes the first roller pair 31 to convey the recording sheet 90 intermittently, is completely stopped. In that case, it is only required that the driving of the LF motor 77 and the conveyance of the recording sheet 90 be stopped before the carriage 38 reaches a position where one-pass image recording is started.

When the controller 70 determines that only two passes are left, in other words, when the controller 70 determines the next pass is the pass immediately before the last one pass to be performed on the first sheet (S15: Yes), the controller 70 determines based on the printing data whether or not image recording is to be performed on the next recording sheet 90 (the second sheet) (S17). When the controller 70 determines that no image recording is to be performed on the next recording sheet 90 (S17: No), the controller 70 performs image recording corresponding to the remaining two passes (remaining two one-pass image recording) (S18) similarly to the above method. Then, the controller 70 continuously drives the LF motor 77 to discharge the recording sheet 90 for which the image recording has been completed from the conveyance path 23 to the discharge tray 16 (S19), and then ends the image recording.

When the controller 70 determines that image recording for the next recording sheet 90 (the second sheet) is to be performed (S17: Yes), the controller 70 drives the ASD motor 83 on condition that the LF motor has completed the intermittent conveyance immediately before the last intermittent conveyance of the recording sheet 90 (the first sheet). In that case, the first current limit value L1 is set as the current limit value of the ASF motor 83. Driving the ASF motor 83 to rotate the feed roller 25 feeds the next recording sheet 90 from the feed tray 15 to the conveyance path 23 (S20, exemplary feed processing).

The controller 70 performs the remaining two one-pass image recording while driving the ASF motor 83 similarly to the above method (S21). As depicted in FIG. 5, in the intermittent conveyance corresponding to the remaining two passes, there is timing at which the LF motor 77 is driven concurrently with the ASF motor 83. Further, in the image recording corresponding to the remaining two passes, there is timing at which the CR motor 79 is driven concurrently with the ASF motor 83.

The first current limit value L1 of the ASF motor 83 is set so that the total of the first current limit value L1, the current limit value of the LF motor 77, and the current limit value of the CR motor 79 does not exceed a maximum current value of a power source of the multifunction peripheral 10. Thus, even when a load is applied to the intermittent conveyance of the recording sheet 90 by use of the first roller pair 31 and the current corresponding to the current limit value flows through the LF motor 77, no current exceeding the capacity flows through the power source of the multifunction peripheral 10.

The controller 70 monitors the output of the resist sensor 44 while driving the ASF motor 83, and determines whether or not the leading end of the recording sheet 90 reaches the position of the resist sensor 44 (S22). When the controller 70 determines that the leading end of the recording sheet 90 reaches the position of the resist sensor 44 (S22: No), the controller 70 corrects the skew of the next recording sheet 90 similarly to the above (S12).

The controller 70 determines that the next recording sheet 90 has feed failure (S22: Yes) on condition that the resist sensor 44 does not detect the next recording sheet 90 even after driving the ASF motor 83 by a predefined amount. The controller 70 stops the ASF motor 83, reads the second current limit value L2 from the ROM 72, and sets it as the current limit value of the ASF motor 83 (S23) on condition that the controller 70 has determined that the next recording sheet 90 has the feed failure and the last intermittent conveyance of the preceding recording sheet 90 by using the LF motor 77 has been completed (S24: Yes). Then, the controller 70 performs refeed processing in which refeeding of the next recording sheet 90 from the feed tray 15 is performed by driving the ASF motor 83 again (S25).

In the refeed processing, the second current limit value L2 is set in the ASF motor 83. Thus, even if a load, such as friction between recording sheets, is applied to the feeding of the next recording sheet 90, the ASF motor 83 can be driven by a current larger than the first current limit value L1. This reduces the occurrence of feeding failure of the next recording sheet 90 in the refeed processing. Further, as depicted in FIG. 5, the last intermittent conveyance of the preceding recording sheet 90 has been completed when the refeed processing is started. Thus, the driving of the ASF motor 83 having the second current limit value L2 does not overlap with the driving of the LF motor 77. Namely, the driving of the LF motor 77 is stopped while the ASF motor 83 having the second current limit value L2 is driven. Meanwhile, the driving of the ASF motor 83 having the second current limit value L2 may overlap with the driving of the CR motor 79. Namely, the refeed processing of the next recording sheet 90 and the last one-pass image recording on the preceding recording sheet 90 may be performed at the same time. In that case, however, the total of the second current limit value L2 and the current limit value of the CR motor 79 is not more than the maximum current value of the power source of the multifunction peripheral 10. Thus, even when the current corresponding to the second current limit value L2 flows through the ASF motor 83, no current exceeding the capacity flows through the power source of the multifunction peripheral 10.

[Action and Effect of Embodiment]

In the feed processing of this embodiment, the first current limit value L1 is set in the ASF motor 83 and then the ASF motor 83 having the first current limit value L1 is driven. This reduces an entire power consumption of the multifunction peripheral 10 even when the LF motor 77 is driven concurrently with the ASF motor 83. When the feed failure of the next recording sheet 90 occurs, the second current limit value L2 is set in the ASF motor 83 and then the ASF motor 83 having the second current limit value L2 is driven after completion of the last intermittent conveyance of the preceding recording sheet 90. This reliably feeds the next recording sheet 90. Accordingly, a power source, of which capacity is smaller than the total of the current limit values of the motors (i.e., the total of the second current limit value L2, the current limit value of the LF motor 77, and the current limit value of the CR motor 79), can be used by reducing the power consumption of the motors while preventing the deterioration in throughput in the continuous recording processing.

In this embodiment, the CR motor 79 may be driven to move the carriage 38 before the driving of the LF motor 77, which causes the first roller pair 31 to convey the recording sheet 90 intermittently, is stopped completely. This improves the throughput of image recording.

The first current limit value L1 may be smaller than the current limit value of the LF motor 77. Therefore, the current limit value of the LF motor 77 is hardly limited compared to the current limit value of the ASF motor 83. This reduces the deterioration in throughput of image recording.

[Modified Embodiments]

The refeed processing of the next recording sheet 90 may be performed by setting the second current limit value L2 in the ASF motor 83 and driving the ASF motor 83 having the second current limit value L2, when the condition, in which the recording head 39 has completed the ink jetting corresponding to the last one pass onto the preceding recording sheet 90, is satisfied in addition to the conditions described in the above embodiment. This reduces the possibility of driving the ASF motor 83 having the second current limit value L2 and the CR motor 79 at the same time. Namely, the driving of the LF motor 77 and the CR motor 79 may be stopped while the ASF motor 83 having the second current limit value L2 is driven.

In the above embodiment, the power circuit supplying the current to the driving circuit 78 of the LF motor 77 and the driving circuit 84 of the ASF motor 83 may be designed as a circuit different from the power circuit supplying the current to the driving circuit 80 of the CR motor 79. This allows the current limit values of the LF motor 77 and the ASF motor 83 to be set independent of the current limit value of the CR motor 79.

In the above embodiment, the recording head 39 of the ink-jet system is adopted. In modified embodiments, however, a recording head of any recording system, such as a wire dot system or a thermal system, may be adopted in place of the ink-jet system.

What is claimed is:

1. A serial-type recording apparatus, comprising:

a casing including a conveyance path configured to guide a sheet in a conveyance direction;

a feed tray configured to load sheets;

a feed roller configured to feed each sheet loaded on the feed tray to the conveyance path;

a conveyance roller pair provided in the conveyance path and configured to convey the sheet in the conveyance direction while nipping the sheet;

a carriage provided in the conveyance path at a position downstream of the conveyance roller pair in the conveyance direction and configured to move in a direction intersecting with the conveyance direction;

a recording head carried on the carriage;

a sheet sensor provided in the conveyance path at a position upstream of the conveyance roller pair in the conveyance direction and configured to detect whether or not the sheet is present;

a first motor configured to drive the feed roller;

a second motor configured to drive the conveyance roller pair;

a third motor configured to drive the carriage;

a controller configured to control the first motor, the second motor, and the third motor to execute continuous recording processing in which, before completion of image recording on a first sheet fed before a second sheet, the second sheet is fed from the feed tray; and a memory storing a first current limit value and a second current limit value larger than the first current limit value, of the first motor, wherein the controller is configured to:

drive the second motor to perform intermittent conveyance of the first sheet;

drive the third motor to perform one-pass image recording on the first sheet by use of the recording head while moving the carriage, at least in a state where the first sheet is stopped;

perform the intermittent conveyance and the one-pass image recording alternately and repeatedly to complete the image recording on the first sheet;

set the first current limit value in the first motor and drive the first motor having the first current limit value to feed the second sheet from the feed tray before completion of the image recording on the first sheet;

determine whether feed failure of the second sheet occurs or not based on a detection signal from the sheet sensor; and set the second current limit value in the first motor and drive the first motor having the second current limit value to refeed the second sheet from the feed tray, on condition that driving of the second motor has completed a last intermittent conveyance of the first sheet and the feed failure of the second sheet has been determined.

2. The serial-type recording apparatus according to claim 1, wherein the controller is configured to set the second current limit value in the first motor and drive the first motor having the second current limit value to refeed the second sheet from the feed tray, on condition that the driving of the second motor has completed the last intermittent conveyance of the first sheet, that the feed failure of the second sheet has been determined based on the detection signal from the sheet sensor, and that the recording head has completed a last one-pass image recording on the first sheet.

3. The serial-type recording apparatus according to claim 1, wherein the controller is configured to determine the feed failure of the second sheet on condition that the sheet sensor does not detect the second sheet even after the first motor is driven by a predefined amount.

4. The serial-type recording apparatus according to claim 1, wherein the controller is configured to drive the first motor to feed the second sheet on condition that the second motor has completed intermittent conveyance immediately before the last intermittent conveyance of the first sheet.

5. The serial-type recording apparatus according to claim 1, wherein the controller is configured to drive the third motor to move the carriage before the driving of the second motor is completely stopped, the second motor intermittently conveying the first sheet by use of the conveyance roller pair.

6. The serial-type recording apparatus according to claim 1, wherein the memory stores a current limit value of a second motor, and the first current limit value is smaller than the current limit value of the second motor.

7. The serial-type recording apparatus according to claim 1, wherein the controller is configured to drive the first motor by a predefined amount after the sheet sensor detects the second sheet to correct a skew of the second sheet by bring the conveyance roller pair in a rest state into contact with a leading end of the second sheet.

8. The serial-type recording apparatus according to claim 1, wherein the recording head is an ink-jet head.

9. The serial-type recording apparatus according to claim 1, wherein the memory stores a current limit value of the second motor and a current limit value of the third motor, and a total of the first current limit value, the current limit value of the second motor, and the current limit value of the third motor is not more than a maximum current value of a power source of the serial-type recording apparatus.

10. The serial-type recording apparatus according to claim 1, wherein the memory stores a current limit value of the second motor and a current limit value of the third motor, a total of the second current limit value, the current limit value of the second motor, and the current limit value of the third motor exceeds a maximum current value of a power source of the serial-type recording apparatus, and a total of the second current limit value and the current limit value of the third motor is not more than the maximum current value of the power source of the serial-type recording apparatus.

11. The serial-type recording apparatus according to claim 1, wherein the controller is configured to stop the driving of the second motor while the first motor, in which the second current limit value is set, is driven.

12. The serial-type recording apparatus according to claim 1, wherein the controller is configured to stop the driving of the second motor and the third motor while the first motor, in which the second current limit value is set, is driven.

13. The serial-type recording apparatus according to claim 1, wherein the controller is configured to perform the refeeding of the second sheet concurrently with a last one-pass image recording on the first sheet.

* * * * *